United States Patent [19]

Thomson

[11] 4,038,934

[45] Aug. 2, 1977

[54] ANCHOR HAVING RELEASABLE FLUKES

[75] Inventor: George Thomson, Redwood City, Calif.

[73] Assignee: Columbian Rope Company, Auburn, N.Y.

[21] Appl. No.: 728,645

[22] Filed: Oct. 1, 1976

Related U.S. Application Data

[63] Continuation of Ser. No. 634,445, Nov. 24, 1975, abandoned.

[51] Int. Cl.[2] ..... B63B 21/30

[52] U.S. Cl. ..... 114/298

[58] Field of Search ..... 114/294, 297, 298, 299, 114/310

[56] References Cited

U.S. PATENT DOCUMENTS

| | | | |
|---|---|---|---|
| 2,851,983 | 9/1958 | Hrivnyak | 114/298 |
| 3,082,729 | 3/1963 | Chard | 114/298 |
| 3,283,736 | 11/1966 | Williams | 114/298 |

*Primary Examiner*—George E. A. Halvosa

*Assistant Examiner*—Jesus D. Sotelo

*Attorney, Agent, or Firm*—Schuyler, Birch, Swindler, McKie & Beckett

[57] ABSTRACT

An anchor having an elongated hollow body with a plurality of flukes pivoted to the lower end thereof. A stem inside the body has an upper end projecting through the upper end of the body connected to an anchor line. A connecting member couples a slideable plug held within the body to the stem for movement between a first position, where the plug holds the flukes in an extended operative position, and a second position, where the flukes are released from engagement with a surface. The connecting member, of which there are two embodiments, includes a spring tensioned as the stem is raised to an elevated position by a pull on the anchor line, the spring biasing the plug to its second position. A holding element locks the stem in its elevated position whereby a release of the pull on the anchor line will cause the spring to move the plug to its second position to release the anchor flukes. In one embodiment, the flukes may be moved to a storage position parallel to the body.

11 Claims, 11 Drawing Figures

ANCHOR HAVING RELEASABLE FLUKES

This is a continuation of application Ser. No. 634,445 filed Nov. 24, 1975, now abandoned.

This invention relates to a new and improved anchor having releasable flukes. If the anchor snags on an underwater obstruction, pulling on the anchor line with a force equalling a predetermined amount and then slackening the line unlatches the anchor so that the flukes move to an inoperative position, permitting the anchor to be brought up to the boat and reset.

Prior anchors of this general class have used locking plugs which are released by force exceeding a certain amount. The harder the anchor is pulled, the more the flukes lock. This objection to prior anchors is overcome in the present invention.

Another means of releasing fouled anchors has been to slack off the anchor line and then pull it forceably. However, there is ordinarily not enough slack in anchor lines to perform this release effectively.

A feature of the present invention is the fact that a plug reciprocable in the body of the anchor which controls the position of the flukes is subject to the force of two seperate but related springs at all times. The flukes are released from operative to inoperative position when a predetermined force is initially applied but only when that same force is then removed. When the release mechanism is activated part of the force required to set the mechanism for release is retained by one of the springs. By manual means this kinetic energy retained by this spring is released and used to reset the flukes to their operating position.

Another feature of the invention is the provision of an adjustment screw which adjusts the force on the main spring thereby varying the force required to release the flukes. When the adjustment screw is fully up, the anchor will not trip regardless of the force applied.

Another advantage of the present invention is the fact that the anchor is easily stowed, the flukes being held in retracted position until such time as the user wishes to reset the anchor.

Other objects of the present invention will become apparent upon reading the following specification and referring to the accompanying drawings in which similar charcters of reference represent corresponding parts in each of the several views.

Figure 1:
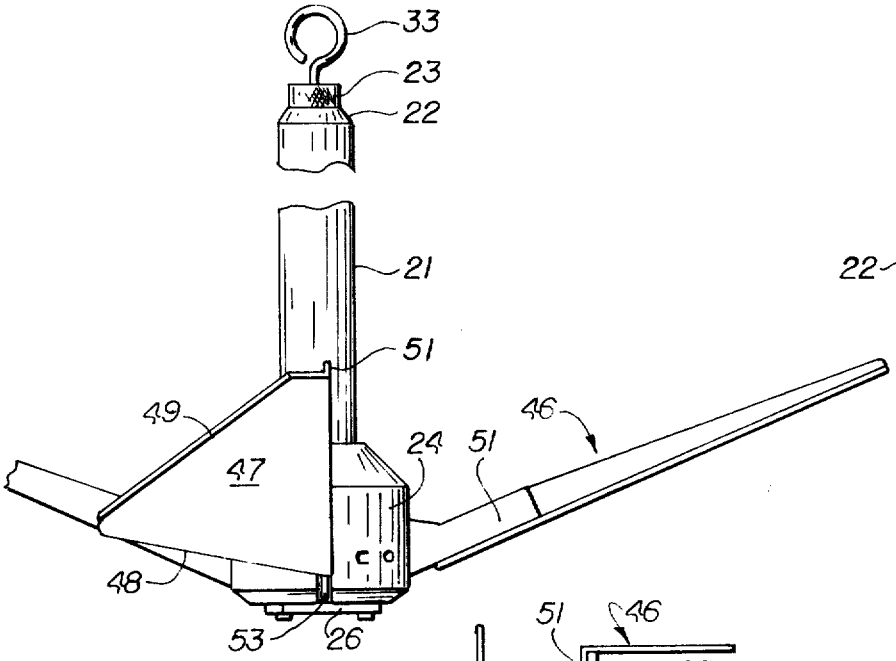
FIG. 1 is an elevational view of one form of the anchor, partly broken away to conserve space and showing the flukes in operative position.
Figure 4:
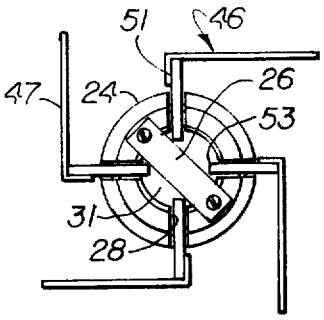
FIG. 4 is a bottom plan view of the structure of FIG. 2.
Figure 3:
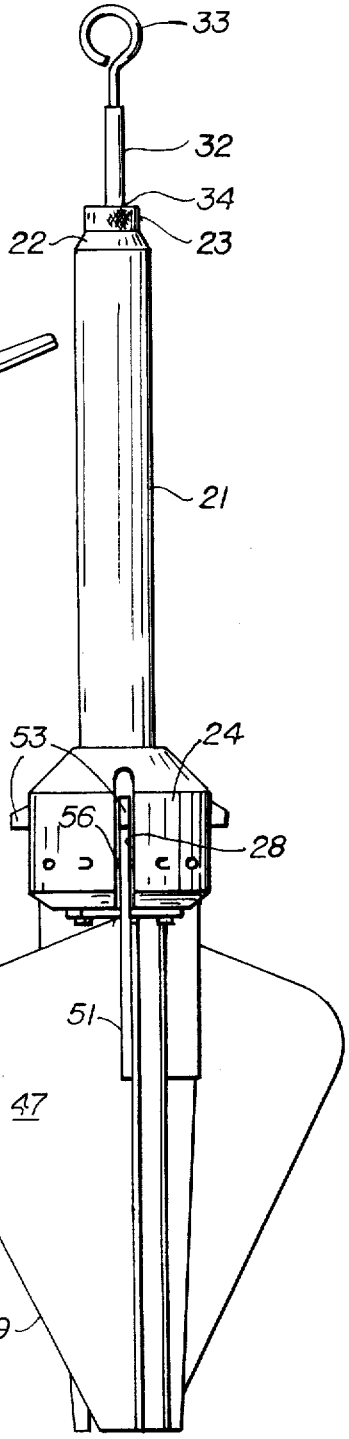
FIG. 3 is a view similar to FIG. 1 showing the flukes in inoperative position.

In the modification shown in FIGS. 1-7 the anchor has a hollow cylindrical body 21 having an inward turned upper end 22 in which is threaded a nut 23 to adjust the force at which the anchor is tripped, as hereinafter explained. At the opposite or bottom end of body 21 is an external collar 24. The bottom of collar 24 is closed off by a stop 26 here shown as being detachable to permit assembly of parts. At its lower end, body 21 is formed with a plurality of radial slots 27 for passage of the flukes as hereinafter explained. Similarly, slots 28 are formed in the collar 24 in registry ith the slots 27. Slideable in the lower end of body 21 is a plug 31 which is of slightly lesser diameter than the inside of body 21. Plug 31 controls the position of the flukes as hereinafter described. Extending through the enlarged hole 29 in nut 23 to a point close to the bottom of body 21 is a stem 32. A hook 33 is attached to the upper end of stem 32 and the anchor line is attached to hook 33. A shoulder 34 is formed on stem 32 spaced downwardly from the upper end thereof. Normally, shoulder 34 is within the body 21 except when the anchor has been cripped. On the lower end of stem 32 is a fitting 36 which at its maximum diameter is somewhat less than the inside of body 21 but which maintains the parts in vertical alignment. Helical upper spring 37 is compressed between the nut 23 at its upper end and the enlarged diameter portion of fitting 36 at its lower end. By adjustment of the position of nut 23, the force of spring 37 may be regulated. When full up, the anchor cannot be tripped.

A secondary or tension spring 38 is interposed between fitting 36 and plug 31 and is formed at either end with hook-like ends 41 which pass around pins 39 in the plug and fitting. When stem 32 is raised relative to body 21 against the force of spring 37, the spring 38 is extended and its tension increased.

As shown in FIGS. 1-7 in a preferred form of the invention, there are four flukes 46 corresponding in number to the slots 27 or 28. The shape of flukes 46 is subject to considerable variation. As shown in the accompanying drawings, there is a relatively flat blade 47 of generally triangular shape having an inner edge 48 and an outer edge 49 which is disposed approximately at right angles thereto, the length of edge 49 being considerably greater than that of edge 48. The third edge of blade 47 is attached to a flange 51 at right angles to the plane of blade 47 and said flange 51 extends at its inner end through the slots 28 and 27 to the interior of body 21. Thus flange 51 has an inner end edge 52 which bears against the cylindrical plug 31 in the operative position shown in FIG. 5. One corner 54 of flange 51 is rounded. The other inner corner is formed with a projection 53. Pins 56 passing through the collar 28 pivotally connect the flukes 46 for pivotal movement relative to body 21, from upward or storage position shown in FIG. 7 to an outward or operative position of FIG. 5 or to a down or retracted position of FIG. 6.

Figure 5:
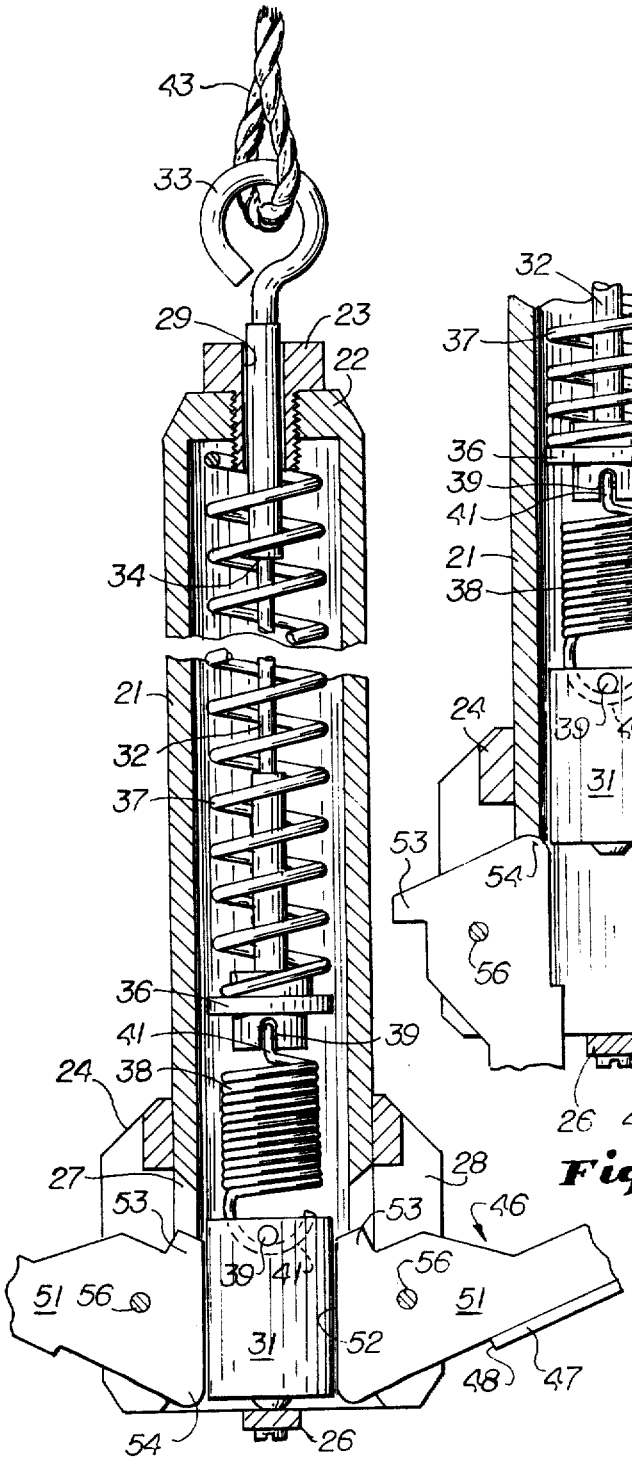
FIG. 5 is a longitudinal vertical section, partly broken away to conserve space, of the anchor in the position of FIG. 1.

In the operative position of FIGS. 1 and 5, the flukes 46 extend out relative to body 21 at an angle of about 60°. The plug 31 is in down position contacting stop 26 and thus bears against the surfaces 52 of the flanges 51. Normal force of the anchor against snags tending to pivot the flukes 46 downward about pins 56 are resisted by contact of the edge 52 with the plug 31.

Figure 5A:
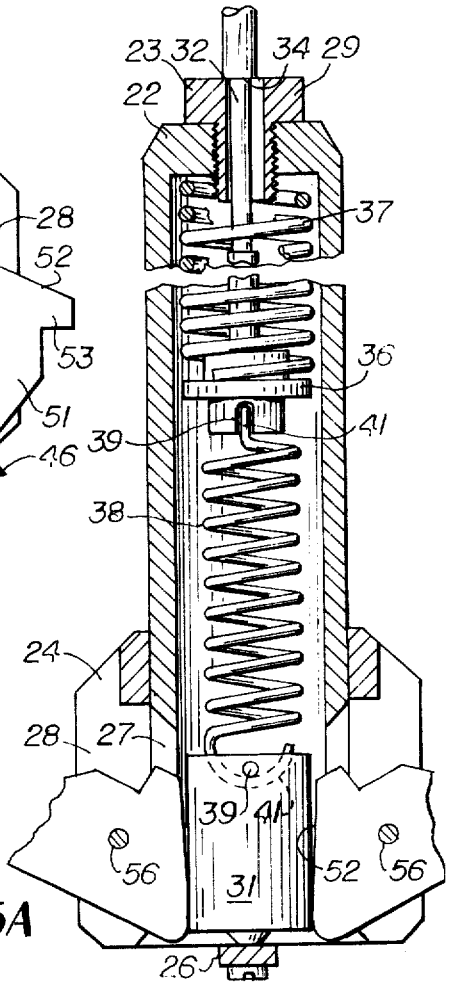
FIG. 5A is a view similar to FIG. 5 showing the parts in an intermediate position.

If the anchor snags, pulling on the hook 33 normally does not dislodge the anchor from the snag. However, depending upon the adjustment of nut 23, when the force of compression spring 37 is overcome, the fitting 36 is pulled upward from the position of FIG. 5 to the position of FIG. 5A, the force from fitting 36 being transmitted to the plug 31 by spring 38. Because line 43 attached to hook or ring 33 is taut, and because at least one fluke 46 is snagged, surface 52 of the snagged fluke bears tightly against plug 31 with a cam-like action, holding plug 31 in place. The stem 32 is pulled out of body 21 with sufficient force so that shoulder 34 is outside nut 23.

Release of the pull on line 43 allows spring 37 to cause the shoulder to rest on the outside of nut 23 (the hole in nut 23 being enlarged for this purpose). This relieves the downward force of spring 37 on fitting 36. Since loosening of line 43 has released the pressure on the snagged luke, the force of surface 52 against plug 31 is relaxed. Spring 38 then pulls the plug 31 up to the position of FIG. 6. Pull on line 43 then swings the flukes to the inoperative position of FIG. 6. When the position of FIG. 6 is reached, the plug 31 is out of contact with the edges 52 permitting the flukes 46 to be swung downward to the position of FIGS. 6 and 3, thereby releasing the snag.

Figure 6:
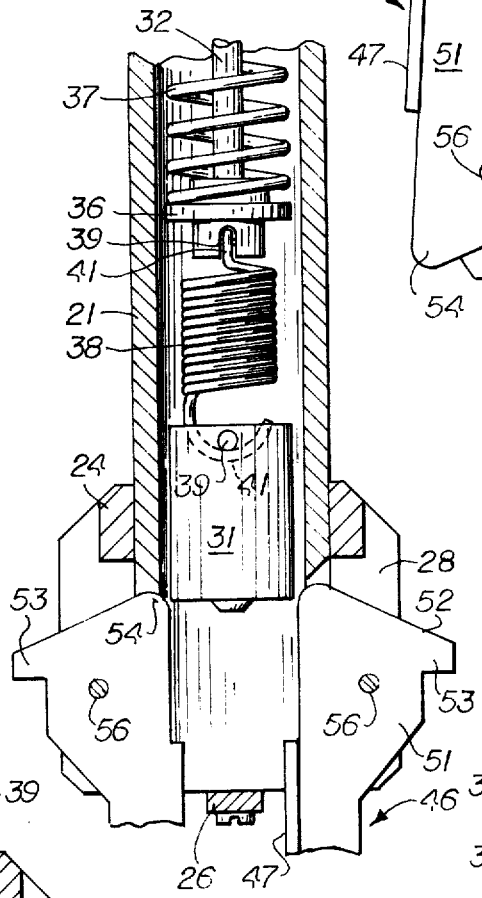
FIG. 6 is a view similar to FIG. 5 showing the parts in the condition of FIG. 3.

When the anchor is pulled to the surface, the user pulls the ring 33 slightly upward from the position of FIG. 6 until the shoulder 34 may be permitted to be drawn inside the body 21. This results in plug 31 returning to the position of FIG. 5.

Figure 7:
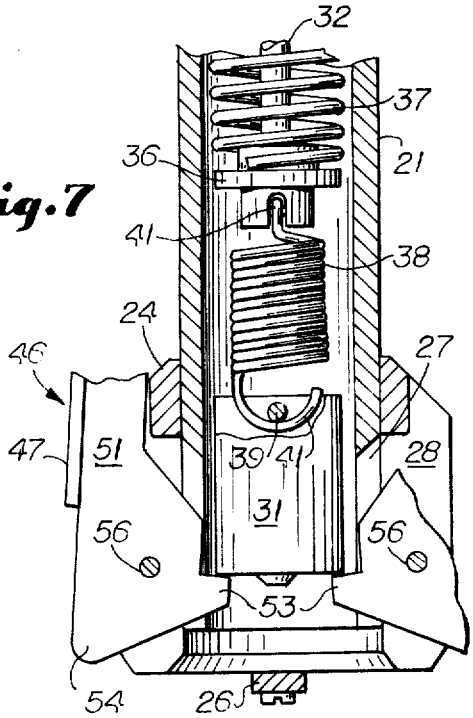
FIG. 7 is a fragmentary sectional view of the parts with the anchor in the position of FIG. 2.

If, instead of restoring the anchor to operative position of FIG. 5 it is desired to store the anchor, the flukes 46 are swung up from the position of FIG. 6 to the position of FIG. 7 before the soulder 34 is released. The plug 31 moves from position of FIG. 6 to the position of FIG. 7 and the lower end of the plug bears against the projections 53, holding the flukes in the storage position of FIG. 2.

Figure 2:
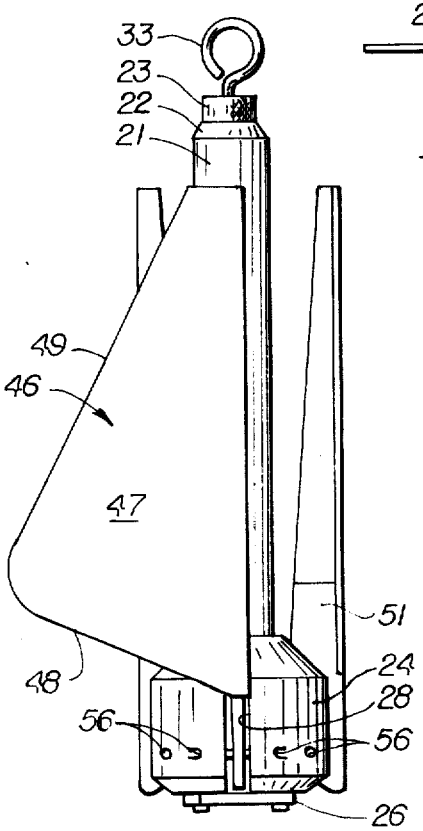
FIG. 2 is a view similar to FIG. 1 showing the flukes in retracted or storage position.

When it is necessary to use the anchor again, the user grasps the hook 33 and with his feet or other convenient means forces the flukes from the position of FIG. 2 to the position of FIG. 1. As soon as projections 53 clear the outside of plug 31 the flukes move to the position of FIG. 5 under the force of spring 37.

In the modification of FIGS. 8–11, many of the parts are quite similar to those of the peceding modification and the same reference numerals followed by the subscipt *a* are used to designate corresponding parts. The lower end of body **21*a* terminates below the slots 28*a* in collar 24*a* and a counterbore 62 is formed in the inside of the lower end of body 21*a*. The upper end 63 of body 21*a* is threaded and the nut 22*a*** is in the form of a collar.

The lower end of spring **37*a* bears against a washer 66 slideable on stem 32*a* and engaging the top of sleeve 67 which slides relative to the interior of body 21*a* and projects below into the interior of collar 24*a*. Collar 81 is fixed to the lower end of stem 32*a* and is retained inside sleeve 67 by retainer 69 fitting in a groove inside sleeve 67 near its upper end. Aligned with stem 32*a* is a lower stem 82 which has a collar 83 on its upper end similar to collar 81 and its lower end is threaded into plug 31*a*. Spring 38*a* surrounds stem 82. Its upper end bears against collar 83 and its lower end against washer 84 held inside sleeve 67 by retainer 68**.

Figure 11:
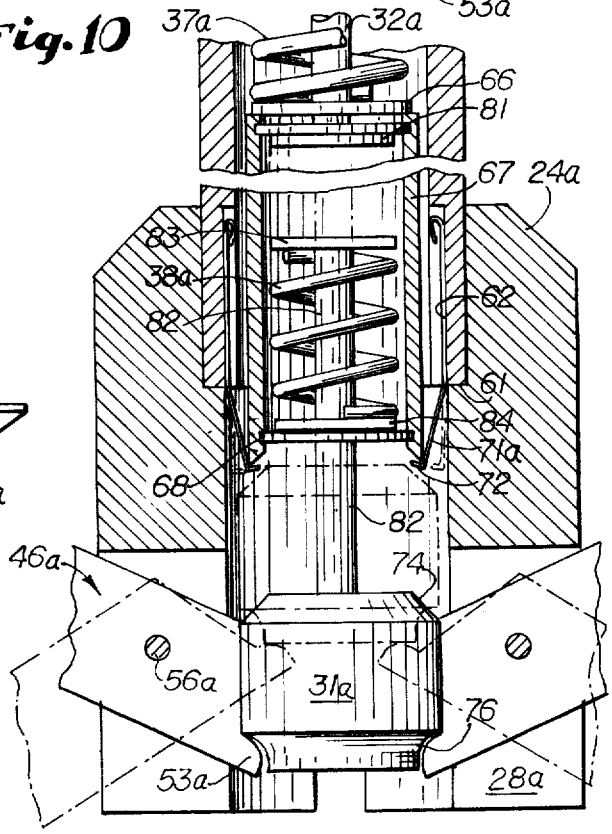

Fitting into the counterbore 62 and projecting downwardly therefrom is a plurality of leaf springs 71 having inward directed fingers 72 at their lower ends. When, as hereinafter explained, and as illustrated in FIG. 11, the sleeve 67 is raised inside body **21*a* the fingers 72 catch under the lower beveled edge 73 of sleeve 67 and hold the sleeve 67** in upward position.

The upper edge of plug **31*a* which is threaded onto the lower end of rod 82 using a male wrench in the recess on the bottom of plug 31*a*. The top of plug 31*a* is formed with a bevel 74. The lower edge of plug 31*a* is formed with a neck 76. The function of bevel 74 is to force the fingers 72 outward when the stem 32*a* is raised relative to body 21*a*. The function of the neck 76 is to provide a seat for the projections 53*a* of the flanges 51*a* of flukes 46*a***.

The flukes **46*a*** are generally similar in function to the flukes of the preceding modification but differ somewhat in external shape, the shape being a matter of choice.

Figure 8:
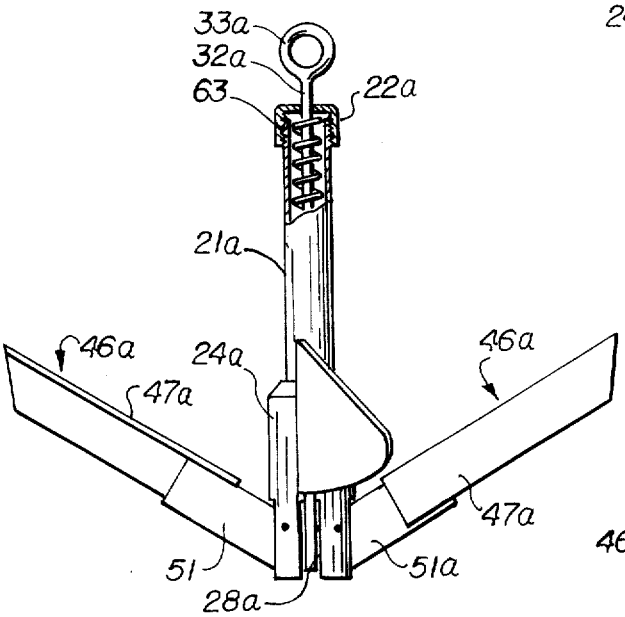
FIG. 8 is a view similar to FIG. 1 of a modified structure.
Figure 10:
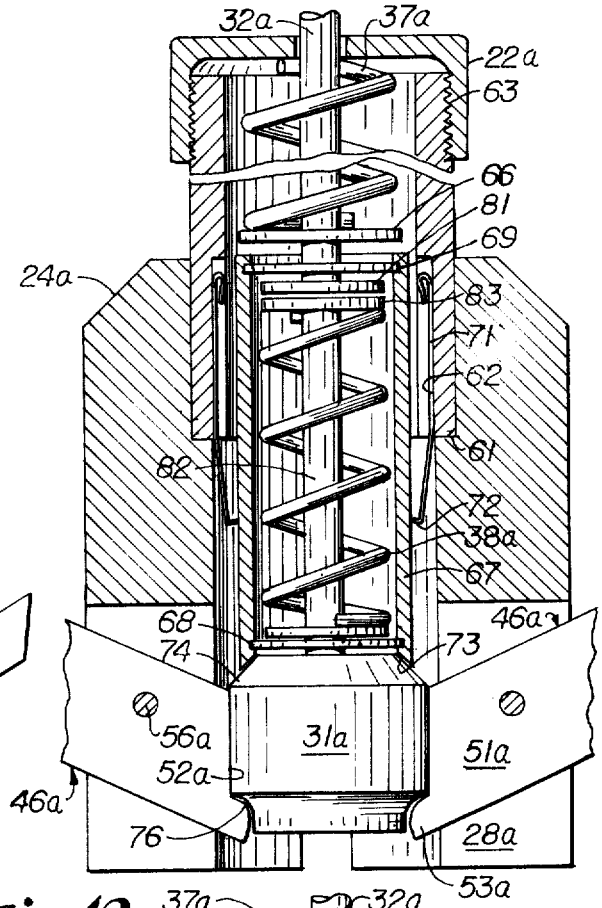
FIGS. 10 and 11 are fragmentary sectional views similar to FIGS. 5 and 7, respectively, of the modification of FIG. 8.
Figure 9:
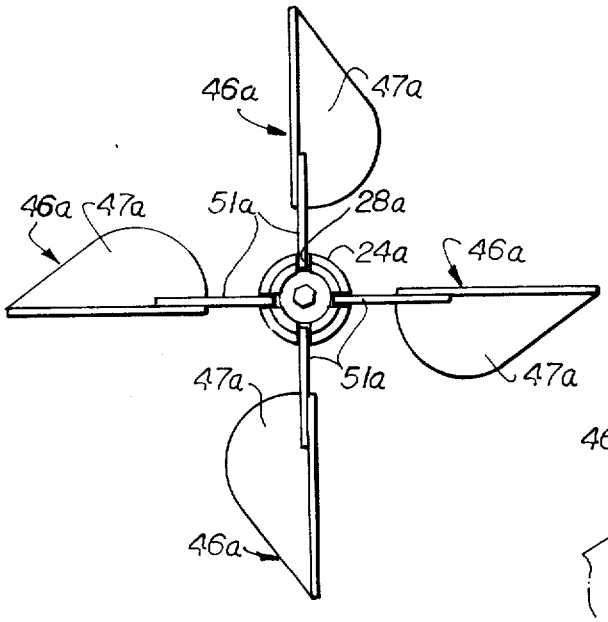
FIG. 9 is a bottom plan view of the structure of FIG. 8.

In the operative position of the anchor, as shown in FIGS. 8 and 10, the surface **52*a* of each flange 51*a* bears against the plug 31*a*, which initially was held in downward projected position by the force of springs 37*a* and 38*a*. The projections 53*a* seat in the grooves 76, holding the flukes 46*a*** out in operative position.

If a snag occurs, pulling on the rope (not shown) which is attached to hook **33*a* pulls the stem 32*a* upward relative to body 21*a* compressing major primary spring 37*a*. Since collar 81 is secured to sleeve 67 by retainer 69, sleeve 67 is pulled upward, but plug 31*a* is held against movement by friction. Hence retainer 68 pulls washer 84 upward on stem 82, compressing spring 38*a*. Sleeve 67 is raised until the fingers 72 of springs 71 grip under the beveled end 73 of the sleeve. This is the solid line position of FIG. 11. When the pull of the anchor line on hook 33*a* is relieved, the pull on flukes 46*a* is relieved. Thus the frictional force holding plug 31*a* is released and the flukes 46*a* can swing down to the dotted line position of FIG. 11, releasing the snag. This brings the beveled surface 74 into contact with the fingers 72, spreading them apart. The spring 38*a* then restroes plug 31*a* to the position of FIG. 10 causing the flukes 46*a*** to spread outwardly to operative position.

What is claimed is:

1. A releasable anchor comprising a. an elongated hollow body;

b. a plurality of flukes pivotally mounted to the lower end of said body, said flukes moveable between an extended position and an inoperative position wherein said flukes extend below said body;

c. a stem slideable within said body, said stem having an upper end extending out of the upper end of said body and having means for attachment to an anchor line;

d. a plug slideable within said body and normally positioned at the lower end of said body, said plug having a first position for locking said flukes in said extended position, and a second position for releasing said flukes whereby said flukes can pivot to said inoperative position;

e. means for connecting said stem and said plug, said connecting means including a first spring capable of being loaded when said stem is raised to an elevated position by a tension pull applied to the anchor line, said first spring, when loaded, biasing said plug towards said second position; and f. means for holding said stem is said elevated position whereby releasing the tension on the anchor line will enable said first spring to move said plug to said second position thereby releasing said flukes for movement to said inoperative position.

2. An anchor according to claim 1 which further comprises a second spring around said stem biasing said plug towards said first position.

3. An anchor according to claim 2 which further comprises an apertured nut in threaded engagement with the upper end of said body and bearing against said second spring to adjust the force of said second spring, said stem extending through the aperture in said nut.

4. An anchor according to claim 3 wherein said holding means comprises a step formed on said stem, said step resting on the outside of said nut when said stem is in said elevated position.

5. An anchor according to claim 2 which further comprises a fitting slideable within said body above said plug, said second spring biasing said fitting downward, said first spring biasing said plug toward said fitting.

6. An anchor according to claim 2 which further comprises a sleeve slideable inside said body, said sleeve being connected to said stem when said stem is raised to said elevated position to raise said sleeve to an upper position, said first spring surrounding a second stem inside said sleeve, said second stem being connected to said plug, and said holding means comprising a resilient member fixed to the inside of said body and having a finger fitting under said sleeve when said sleeve is in said upper position.

7. An anchor according to claim 6 in which said plug has a bevelled surface on its upper edge to engage said finger to move said finger away from said sleeve when said stem is pulled upward to automatically reset said flukes to operative position.

8. An anchor according to claim 6 in which said plug is formed on its lower edge with a neck and said flukes have a projection fitting into said neck to hold said flukes against swinging from operative to inoperative position.

9. An anchor according to claim 1 in which said flukes are movable to a storage position extending upward and parallel to said body.

10. An anchor according to claim 9 in which said flukes have inward projections extending under said plug when said plug is in a third position, said third position being intermediate said first and second positions whereby said plug bears on said projections to hold said flukes in said storage position.

11. An anchor comprising a. an elongated hollow body having radial slots at its lower end;

b. a plurality of flukes;

c. pivot means pivotally mounting said flukes to the lower end of said body, said pivot means extending through said slots so that each fluke swings about said pivot means in one of said slots, each said fluke moveable between an extended position and an inoperative position wherein said flukes extend below said body to be released from engagement with the ground;

d. each said fluke having a first edge extending parallel to the longitudinaly axis of said body along the inside of the wall of said body;

e. a stem slideable within said body, said stem having an upper end extending out of the upper end of said body and having means for attachment to an anchor line;

f. a plug slideable within said body and normally positioned at the lower end of said body, said plug having a first position for locking said flukes in said extended position, and a second position for releasing said flukes whereby said flukes can pivot to said inoperative position;

g. means for connecting said stem and said plug, said connecting means including a first spring capable of being loaded when said stem is raised to an elevated position by a tension pull applied to the anchor line, said first spring, when loaded, biasing said plug towards said second position, and h. means for holding said stem in said elevated position whereby releasing the tension on the anchor line will enable said first spring to move said plug to said second position thereby releasing said flukes for movement to said inoperative position.

* * * * *